US008466098B2

(12) United States Patent
Ghosh et al.

(10) Patent No.: US 8,466,098 B2
(45) Date of Patent: Jun. 18, 2013

(54) WASHING AGENT HAVING STABILIZED ENZYMES

(75) Inventors: Robin Ghosh, Düsseldorf (DE); Andreas Michels, Düsseldorf (DE); Cornelius Bessler, Düsseldorf (DE); Daniela Lowis, Haan (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 251 days.

(21) Appl. No.: 12/783,990

(22) Filed: May 20, 2010

(65) Prior Publication Data

US 2010/0227789 A1 Sep. 9, 2010

Related U.S. Application Data

(63) Continuation of application No. PCT/EP2008/066084, filed on Nov. 24, 2008.

(30) Foreign Application Priority Data

Nov. 28, 2007 (DE) ..... 10 2007 057 583

(51) Int. Cl.

| | |
|---|---|
| ***C11D 9/34*** | (2006.01) |
| ***C11D 9/14*** | (2006.01) |
| ***C11D 3/06*** | (2006.01) |
| ***C11D 3/36*** | (2006.01) |
| ***C11D 3/386*** | (2006.01) |

(52) U.S. Cl.
USPC ..... 510/392; 510/393; 510/467; 510/405; 510/404; 510/403; 510/407; 8/115.51

(58) Field of Classification Search
USPC ..... 510/392, 393, 405; 8/115.51
See application file for complete search history.

(56) References Cited

U.S. PATENT DOCUMENTS

| | | | | |
|---|---|---|---|---|
| 5,039,446 | A * | 8/1991 | Estell | 510/321 |
| 2003/0157088 | A1 * | 8/2003 | Elliott et al. | 424/94.64 |

FOREIGN PATENT DOCUMENTS

| | | | |
|---|---|---|---|
| BE | 1014987 | A6 | 7/2004 |
| EP | 0238216 | A1 | 9/1987 |
| GB | 1379377 | A | 1/1975 |
| GB | 1576946 | A | 10/1980 |
| GB | 2158087 | A | 11/1985 |
| GB | 2187199 | A | 9/1987 |
| WO | 9102792 | A1 | 3/1991 |
| WO | 9300426 | A1 | 1/1993 |
| WO | 9523221 | A1 | 8/1995 |
| WO | 9621716 | A1 | 7/1996 |
| WO | 9641859 | A1 | 12/1996 |
| WO | 0208398 | A2 | 1/2002 |
| WO | 2007113241 | A1 | 10/2007 |

OTHER PUBLICATIONS

Michaelis et al. Kinetics of the Effect of Invertin. Biochemical Journal, 49, (1913), pp. 333-369.
Cheng, Y. et al. Relationship between the Inhibition Constant (K1) and the Concentration of Inhibitor Which Causes 50 per cent Inhibition (I50) of an Enzymatic Reaction. Biochemical Pharmacology, vol. 22, (1973), pp. 3099-3108.
Lipman, D.J. et al. Rapid and Sensitive Protein Similarity Searches. Science, vol. 227, (1985), pp. 1435-1441.
Gornall et al. Determination of Serum Proteins by Means of the Biuret Reaction. J. Biol. Chem., 177 (1948), S. 751-766.
Van Raay, H.G. et al. Zur Bestimmung der proteolytischen Aktivitat in Enzymkonzentraten und enzymhaltigen Wasch-, Spul- und Reinigungsmittein. Tenside. 7, (1970), 125-132.

* cited by examiner

*Primary Examiner* — Robert C Boyle
(74) *Attorney, Agent, or Firm* — David LeCroy

(57) ABSTRACT

The present application relates to washing and cleaning agents, containing phosphate compounds having aliphatic and/or aromatic residues, which act as enzyme stabilizers. Further subjects are the use of such compounds as reversible inhibitors of enzymes, in particular of proteolytic enzymes, and thus as stabilizers in washing or cleaning agents, and further methods and uses correlated therewith.

15 Claims, No Drawings

WASHING AGENT HAVING STABILIZED ENZYMES

CROSS REFERENCE TO RELATED APPLICATIONS

The present application is a continuation of International Application No. PCT/EP2008/066084 filed 24 Nov. 2008, which claims priority to German Patent Application No. 10 2007 057 583.3 filed 28 Nov. 2007.

The present Application relates to washing and cleaning agents containing phosphate compounds having aliphatic and/or aromatic residues which act as enzyme stabilizers.

The use of enzymes in washing and cleaning agents is known in the art. They serve to expand the performance spectrum of the relevant agents in accordance with their specific activities. In particular, these include hydrolytic enzymes such as proteases, amylases, lipases, and cellulases. The first three types of hydrolytic enzymes—proteins, starches, and fats—contribute directly to dirt removal. Cellulases are used for their fabric effect. A further type of washing- and cleaning-agent enzymes are the oxidative enzymes, in particular oxidases, which preferably serve, if applicable in concert with other components, to bleach stains or to generate the bleaching agents in situ. In addition to these enzymes (which continue to be optimized), further enzymes are constantly being made available for use in washing and cleaning agents to optimally address specific stains (e.g., pectinases, β-glucanases, mannanases, or further hemicellulases for hydrolysis of, in particular, specific plant-derived polymers).

The longest-established enzymes contained in practically all modern high-performance washing and cleaning agents are proteases, and among them in particular serine proteases, which also include the subtilases. They break down protein-containing stains on cleaned materials. They also hydrolyze themselves (autoproteolysis) and other proteins contained in the relevant agents (i.e., other enzymes). This happens especially during cleaning in the aqueous washing bath when comparatively favorable reaction conditions exist. This also happens during storage of the relevant agents, with an increasing storage time always associated with a certain loss of enzyme activities (e.g., protease activity). As a rule, enzyme activity in the washing or cleaning agent is inversely proportional to storage time—enzyme activity continually decreases with increasing storage time. This is particularly problematic in gelled, liquid and particularly water-containing recipes, since the water present in them makes available both the reaction medium and the hydrolysis reagent.

An objective in the development of washing and cleaning agents is therefore to stabilize enzymes contained therein, especially during storage. This is to protect the enzymes from a variety of unfavorable influences such as denaturing or decomposition due to physical influences or oxidation. One focus of these developments involves protecting the proteins and/or enzymes in the agents from proteolytic cleavage. This can be accomplished by physical barriers (e.g., by encapsulating the enzymes in special enzyme granulates) or by formulating the agents in two- or multi-chamber systems. Another route often taken involves adding chemical compounds to the agents that inhibit the proteases and thus act overall as stabilizers for the proteases and other proteins and enzymes present in the agents. These protease inhibitors must be reversible, since protease activity needs to be suppressed only temporarily (especially during storage), but not during the cleaning process.

Polyols, in particular glycerol and 1,2-propylene glycol, benzamidine hydrochloride, borax, boric acids, boronic acids, or salts or esters thereof, are established in the existing art as reversible protease inhibitors. Included among them are derivatives having aromatic groups (e.g., ortho-, meta-, or para-substituted phenylboronic acids, particularly 4-formylphenylboronic acid (4-FPBA)) or the respective salts or esters of the aforesaid compounds. Particularly good protection results when boric acid derivatives are used with polyols, since they form a complex that stabilizes the enzyme. Peptide aldehydes (i.e., oligopeptides having a reduced C-terminus), in particular those made up of 2 to 50 monomers, are also used for this purpose. Ovomucoid and leupeptin, among others, are among the peptide-type reversible protease inhibitors. Specific reversible peptide inhibitors as well as fusion proteins of proteases and specific protease inhibitors are also used for this.

Polyols such as glycerol and 1,2-propylene glycol have, however, proven disadvantageous because of the high utilization concentration that they require, since other active substances in the agents can then be contained only in correspondingly smaller proportions.

Boric acid derivatives occupy a prominent place among serine protease inhibitors effective at a comparatively low concentration. International Patent Application WO 96/21716 A1, for example, discloses that boric acid derivatives acting as protease inhibitors are also suitable for stabilizing enzymes in washing and cleaning agents. A selection of particularly high-performance stabilizers is disclosed in International Patent Application WO 96/41859 A1.

Independently of their stabilizing effect, however, boric acid derivatives have a critical disadvantage. Many boric acid derivatives such as borate form undesired byproducts with other washing- or cleaning-agent ingredients, so that the latter are no longer available for the desired cleaning purpose in the agents, or remain behind on the washed material as a contaminant.

The present invention therefore provides boron-free chemical compounds that act as enzyme inhibitors and are thus suitable as enzyme stabilizers in washing and cleaning agents. The present invention further provides boron-free chemical compounds that act as protease inhibitors and are thus suitable as stabilizers or proteases and/or also for other enzymes in washing and cleaning agents. Accordingly, the present invention provides a washing or cleaning agent having a boron-free chemical compound of this kind.

In this context, utilization in washing and cleaning agents that are liquid, gelled, or pasty was of particular interest, and among them especially in those that contain water.

A subject of the invention is a washing or cleaning agent containing an enzyme and a compound of the general structural formula—

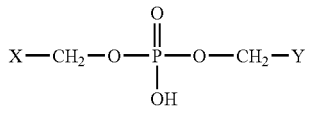

wherein X is an aliphatic or an aromatic residue, and Y is an aliphatic or an aromatic residue.

It has been surprisingly found that such compounds effectively stabilize enzymes, particularly proteases, present in washing and cleaning agents according to the present invention compared to borate as an enzyme stabilizer, even at a lower or equivalent concentration. These compounds thus create leeway for formulation of washing and cleaning agents by making it possible to use enzyme stabilizers known from the art, for example, 1,2-propylene glycol or boron compounds (e.g., borates and other boric acid derivatives, or 4-FPBA), at a lower concentration, or to omit them entirely.

In a preferred embodiment of the invention, the residues X and Y of the washing or cleaning agent are identical, with the residue X being —$CH_2$—$CH_2$—$CH_3$ or phenyl, and the residue Y likewise being —$CH_2$—$CH_2$—$CH_3$ or phenyl. A particularly preferred compound therefore comprises a —$CH_2$—$CH_2$—$CH_3$ group as residue X and residue Y. A further particularly preferred compound thus comprises a phenyl group as residue X and residue Y. All washing and cleaning agents having compounds of the general structural formula indicated above nevertheless represent further embodiments of the present invention, provided the residues X and Y are respectively aromatic or aliphatic and the compound stabilizes an enzyme in the washing or cleaning agent. It is also possible for residue X to be aliphatic and residue Y aromatic, or residue X aromatic and residue Y aliphatic.

"Washing or cleaning agents" according to the present invention includes all agents suitable for the washing or cleaning of, in particular, textiles and/or solid surfaces.

An "enzyme" according to the present Application refers to a protein that performs a specific biocatalytic function. A "protease" is understood for purposes of the present Application as an enzyme that catalyzes hydrolysis of peptide bonds and is thereby capable of cleaving peptides or proteins.

The present invention includes the aforesaid compounds in all protonated and/or deprotonated forms. If applicable, oppositely charged cations ($H^+$, $Na^+$, $K^+$ or the like) or anions ($Cl^-$, $Br^-$, formate, acetate, etc.) are present. The present invention can be implemented in all these forms. What is critical in each case is the interaction between the compound relevant to the invention, which stabilizes the enzyme, and the enzyme that is to be stabilized according to the present invention.

Without necessarily being tied to this theory, it is assumed according to the present invention that the compounds relevant to the invention (i.e., the stabilizing compounds) form a complex with the enzyme to be stabilized. Noncovalent bonding of the stabilizing compound into or onto the substrate binding pocket of the enzyme presumably occurs. The active center of the enzyme is thereby blocked by a compound that cannot be hydrolyzed by that enzyme, and therefore is no longer available for catalysis of further given substrates. The stabilizing effect of the compound thus results from inhibition of the enzyme. The bond here is reversible (i.e., there is equilibrium between association and dissociation). The equilibrium coefficient of this reaction is referred to as the inhibition constant, or $K_i$. Because of the reversible bonding of the stabilizing compound to the enzyme, the enzyme is inhibited in the washing or cleaning agent and thereby stabilized, whereas the complexes dissociate in intensified fashion upon use of the washing and cleaning agent because of the changed conditions, for example as a result of dilution of the washing or cleaning agent in the washing or cleaning solution, the presence of further or higher-affinity enzyme substrates, or the change in pH in the washing or cleaning solution. The terms "stabilizing" and "inhibiting," as well as "stabilizer" and "inhibitor," are therefore to be regarded in the present Patent Application as identical in meaning.

Because the equilibrium coefficient or inhibition constant $K_i$ as described is significant for the functionality of the compound as an enzyme stabilizer, a further subject of the invention is a washing or cleaning agent containing a compound having, with respect to the enzyme, an inhibition constant ($K_i$) from 0.01 to 10 mM. In a further preferred embodiment of the invention, the washing or cleaning agent is characterized in that the stabilizing compound has, with respect to the enzyme, an inhibition constant ($K_i$) from 0.03 to 5 mM.

The inhibition constant $K_i$ can be determined in the following manner.

The inhibition constant $K_i$ is a variable for characterizing a reversible inhibitor of enzymatic activity. $K_i$ describes the equilibrium between enzyme, inhibitor, and enzyme-inhibitor complex for a reversible bond. The enzyme-inhibitor complex is not catalytically active and inhibits the reaction by decreasing the concentration of free enzyme that is still available to bind substrate. $K_i$ is accordingly defined as $$K_i=[I]\times[E]/[EI]$$

wherein [E], [I], and [EI] are the respective molar equilibrium concentrations of the enzyme (E), inhibitor (I), and enzyme-inhibitor complex (EI). In accordance with this definition, a substance having a low $K_i$ under the respective test conditions is a good inhibitor.

$K_i$ is determined on the basis of an activity test for the protease in the presence of the corresponding inhibitor. Using Michaelis-Menten kinetics established and known to one skilled in the art (Leonor Michaelis, Maud Menten (1913), "Die Kinetik der Invertinwirkung" [The kinetics of invertin action], BIOCHEM. Z. 49:333-369), the enzymatic parameters $K_m$ and $K_{cat}$ are determined in the presence of various concentrations of the inhibitor. A simplified representation of Michaelis-Menten kinetics is—

$$E + S \underset{k_{-1}}{\overset{k_1}{\rightleftharpoons}} ES \xrightarrow{k_2} E + P$$

wherein

E=enzyme

S=substrate

ES=enzyme-substrate complex

P=product $k_1$, $k_{-1}$, $k_2$=rate constants

Here $k_2$ is an indication of the maximum reaction rate at substrate saturation (Vmax), also called the turnover number, molecular activity, or kcat (kcat=Vmax/[Eo], where [Eo] is the initial concentration of the enzyme). The Michaelis constant (i.e., the substrate concentration at which half saturation exists, that is, at which the reaction rate v=Vmax/2) turns out to be $$K_m=k_{-1}/k_1$$

(Michaelis-Menten instance, which exists when k2<<k1), or more generally—

$$K_m=k-_1+k_2/k_1$$

(Briggs-Haldane situation, which exists for the case in which k2 is not negligible with respect to k1).

The saturation function of a "Michaelis-Menten enzyme" is calculated, using the parameters $K_m$ and $V_{max}$, as follows—

$$v = \frac{v'_{max}[S]}{K_m + [S]}$$

wherein v=formation rate of P (v="rate") [mol l-1 s-1]

vmax=maximum rate [mol l-1 s-1]

Km=Michaelis-Menten constant [mol l-1]

[S]=substrate concentration [mol l-1]

The inhibition constant $K_i$ is obtained by determining the initial catalysis rate ($V_{init}$)—for proteases, the initial hydrolysis rate—at different substrate concentrations [S], and adapting the experimental data in Equation 1 below—

$$V_{init}=k_{cat}\times[S]\times E_0/(K_m\times(1+[I]/K_i)+S) \quad \text{Equation 1}$$

wherein [I] once again is the inhibitor concentration.

Alternatively, $K_i$ can be determined using the Cheng-Prusoff equation (equation 2, Cheng, Y., Prusoff, W. H. (1973) Biochem. Pharmacol. 22, 3099-3108) via the $IC_{50}$ value. The $IC_{50}$ value is determined by determining the catalytic activity on a substrate in the presence of differing concentrations of the inhibitor, and adapting the experimental data to a sigmoidal dose-effect equation of variable slope (pseudo-Hill slopes). This is the inhibitor concentration necessary in order to achieve 50% inhibition.

$K_i$ is thus obtained from the following Equation 2—

$$K_i=IC_{50}/(1+[S]/K_d) \quad \text{Equation 2}$$

wherein [S] is the substrate concentration in the test and $K_d$ the dissociation constant for thesubstrate, which constant, at the $IC_{50}$ concentration of the inhibitor, can be set to be identical to $K_m$ for the substrate.

$K_i$ values determined in this fashion characterize the compound in terms of the enzyme that is used. In Example 1, the residual activity of a protease, namely the *Bacillus lentus* alkaline protease F49 (according to WO 95/23221 A1) in the presence of an inhibitor was determined. Because this is a typical subtilisin protease, the values obtained with this enzyme are also typical for other serine protease, in particular other subtilisin proteases. In doubtful cases, the exact value for an enzyme of interest must be ascertained on the basis of the particular specific enzyme.

As already explained above, an advantage of compounds according to the present invention that provide stabilization of at least one enzyme in washing and cleaning agents, as compared with the existing art, is that they exhibit favorable inhibition constants with respect to enzymes used in washing and cleaning agents. This applies in particular to proteases, but also to other enzymes. Largely reversible bonding of the inhibitors is thus ensured (i.e., they enter into interactions with the enzyme that are not too strong and not too loose). Advantageously, during storage of the washing or cleaning agents, the majority of enzymes exist in the form of an enzyme-inhibitor complex. The enzymes, in particular proteases, and, if applicable, further proteins that are present, are protected in this fashion, for example, with respect to the catalytic, particularly hydrolytic activities of these enzymes. Proteases are therefore protected from proteolysis by these enzymes (i.e., they are stabilized against proteolysis). When the washing or cleaning agent according to the present invention is diluted with water to produce an aqueous washing or cleaning solution during cleaning, the binding equilibrium is shifted towards dissociation, dissolving the complex and catalytically activating the majority of enzymes relevant to the invention. Compounds according to the present invention are therefore functioning enzyme inhibitors and thus enzyme stabilizers for washing and cleaning agents.

Compounds according to the present invention further exhibit a reduced volume requirement versus established enzyme stabilizers of the existing art, for example, as compared with polyols.

A further advantage of compounds relevant to the invention as compared with the existing art is that they comprise only carbon (C), hydrogen (H), phosphorus (P), and oxygen (O) as elements and, in particular, are free of boron. They therefore do not form with other washing- or cleaning-agent ingredients undesirable byproducts attributable to boron.

They moreover possess good water solubility so that they can easily be incorporated into corresponding washing and cleaning agents. Precipitation during storage is moreover thereby decreased or entirely avoided.

In principle, the aforesaid compounds therefore probably function as reversible inhibitors since they are structurally similar to the substrate of the enzymes, particularly (with regard to proteases) in terms of the acid-amide bond hydrolyzed. Conversely, enzymes, preferably proteolytic enzymes, can therefore be inhibited by compounds according to the invention. This applies in particular to serine proteases, as shown in the Examples of the present Application by the positive effect of the above-described compounds with reference to subtilisins.

In washing or cleaning agents that exist in a preferred embodiment in predominantly solid form, and in a second embodiment in predominantly liquid, pasty, or gel form, the enzyme is preferably contained at a concentration of from 2 μg to 20 mg per g of the agent, more preferably from 5 μg to 17.5 mg per g of the agents, particularly preferably from 20 μg to 15 mg per g of the agent, very particularly preferably from 50 μg to 10 μg of the agent.

The compound (i.e., the stabilizer) is contained in agents according to the present invention in particular at a concentration of up to 50 mg per g of the agent, by preference up to 10 mg, particularly preferably up to 7 mg, very particularly preferably up to 5 mg per g of the agent. It is further preferred that the quantity of the compound (i.e., the compound stabilizing the enzyme) contained in the agent is equal to from 0.01 to 100 times the inhibition constant $K_i$, by preference 0.1 to 10 times $K_i$, particularly preferably 1 to 5 times $K_i$, based on the stabilized enzyme.

The molar ratio of the stabilizing compound to the enzyme is by preference 1:1 to 1000:1, in particular from 1:1 to 500:1, particularly preferably from 1:1 to 100:1, very particularly preferably from 1:1 to 20:1.

A further subject of the invention involves washing or cleaning agents having enzymes chosen from protease, amylase, cellulase, hemicellulase, mannanase, tannase, xylanase, xanthanase, β-glucosidase, carrageenase, oxidase, oxidoreductase, lipase, esterase, or mixtures thereof. In a particularly preferred embodiment, the washing or cleaning agent contains an enzyme that is a protease, preferably a serine protease, more preferably a subtilase, and particularly preferably a subtilisin. This is because washing and cleaning agents, or more generally, enzyme-containing compositions such as highly concentrated enzymes containing at least one proteolytic enzyme (protease), shelf stability of the enzymes is a general problem. Because of their enzymatic activity, proteolytic enzymes lead to the hydrolysis of proteins such as enzymes and peptides contained in the composition, whether they are other proteins or enzymes or even the proteases themselves. Hydrolysis of the proteases as a result of their own proteolytic activity is referred to as autoproteolysis. The degree of shelf stability of the proteins or enzymes contained in a protein/enzyme composition is therefore particularly dependent on the proteolytic activity of a protease within that composition. In order to enhance shelf stability of the enzymes in such a composition, it is therefore necessary to inhibit proteolytic activity of the protease during storage. This can be accomplished by adding a compound according to the present invention which represents, for the protease contained in the composition, a specific and reversible inhibitor having a high affinity for the protease.

Examples of such proteases are the subtilisins BPN' and Carlsberg, protease PB92, subtilisins 147 and 309, the alkaline protease from *Bacillus lentus*, subtilisin DY, and the enzymes (to be classified, however, as subtilases and no longer as subtilisins in the strict sense) thermitase, proteinase K, and the proteases TW3 and TW7. Subtilisin Carlsberg is obtainable in further developed form under the trade name Alcalase® from Novozymes A/S, Bagsvaerd, Denmark. Subtilisins 147 and 309 are marketed by the Novozymes Company under the trade names Esperase® and Savinase®, respectively. The protease variants marketed under the designation BLAP® are derived from the protease from *Bacillus lentus* DSM 5483.

Other usable proteases are, for example, enzymes obtainable under the trade names Durazym®, Relase®, Everlase®, Nafizym, Natalase®, Kannase®, and Ovozymes® from the Novozymes company, under the trade names Purafect®, Purafect® OxP, and Properase® from the Genencor company, under the trade name Protosol® from Advanced Biochemicals Ltd., Thane, India, under the trade name Wuxi® from Wuxi Snyder Bioproducts Ltd., China, under the trade names Proleather® and Protease P® from Amano Pharmaceuticals Ltd., Nagoya, Japan, and under the designation Proteinase K-16 from Kao Corp., Tokyo, Japan.

It has been surprisingly found that such proteases can be particularly well stabilized or reversibly inhibited by the compounds mentioned above. In addition, certain variants of proteases, including variants of the aforementioned proteases, are also particularly advantageously stabilized by these compounds. Such protease variants are part of the subjects of the invention that are described hereinafter.

A protease stabilized or reversibly inhibited according to the present invention can be a wild-type enzyme or a protease variant. "Wild-type enzyme" refers to an enzyme that is present in, or can be isolated from, a naturally occurring organism or a natural habitat. Enzymes are changeable, however, and in some cases are deliberately modified, especially in order to adapt their properties to the intended utilization purposes or to influence their catalytic activity. These modifications are often accomplished by changing the amino acid sequence of the enzyme. Such modifications can be made in deliberate and thus locally directed fashion, or randomly, for example using random mutagenesis methods. An "enzyme variant" refers to enzymes generated from an initial enzyme (e.g., a wild-type enzyme) by modification of the amino acid sequence. Modification of the amino acid sequence is preferably accomplished by mutations, in which context amino acid substitutions, deletions, insertions, or combinations thereof can be performed. The introduction of such mutations into proteins is established art and is sufficiently known to one skilled in the art of enzyme technology. In principle, all enzymes can be modified in this fashion. Protease variants are preferred according to the present invention. These were generated from an initial protease, for example a wild-type protease, by modifying the amino acid sequence, in which context preferably amino acid substitutions, deletions, insertions, or combinations thereof were performed. The initial protease does not necessarily, however, need be a naturally occurring wild-type protease; a protease known from the existing art, to which modifications have already been made, can also be further developed, and can therefore serve once again as an initial protease for generating further protease variants.

For example, all the proteases described above can thus be used in unmodified fashion in agents according to the present invention and can be stabilized by the compounds described. They can, however, also represent the initial enzyme for a variant, which is then contained in an agent according to the present invention and stabilized by means of the compounds described.

Further preferred among the proteases or variants described is the wild-type enzyme or initial enzyme of the variant—

- the alkaline protease from *Bacillus amyloliquefaciens* (BPN'),
- the alkaline protease from *Bacillus licheniformis* (subtilisin Carlsberg),
- the alkaline protease PB92,
- subtilisin 147 and/or subtilisin 309 (Savinase),
- the alkaline protease from *Bacillus lentus*, by preference from *Bacillus lentus* DSM 5483,
- the alkaline protease from *Bacillus alcalophilus* (DSM 11233),
- the alkaline protease from *Bacillus gibsonii* (DSM 14391) or an alkaline protease at least 70% identical thereto,
- the alkaline protease from *Bacillus* sp. (DSM 14390) or an alkaline protease at least 98.5% identical thereto,
- the alkaline protease from *Bacillus* sp. (DSM 14392) or an alkaline protease at least 98.1% identical thereto,
- the alkaline protease from *Bacillus gibsonii* (DSM 14393) or an alkaline protease at least 70% identical thereto.

In a further embodiment of the invention, the washing or cleaning agent comprises a protease obtained from an initial protease by means of at least one modification of an amino acid, the modification being a substitution, insertion, or deletion of an amino acid, and it is at least 90%, by preference at least 92.5%, particularly preferably at least 95%, and very particularly preferably at least 97.5% identical to the initial protease at the amino acid level.

Methods for carrying out and preparing sequence comparisons (so-called alignments) are known to one skilled in the art of enzyme technology. Such sequence comparisons are used, for example, to ascertain the identity or homology values for sequences that are to be compared. A comparison of this kind is made by mutual association of similar successions in the nucleotide or amino-acid sequences of the proteins in question. This is called "homologation." A tabular association of the relevant positions is referred to as an "alignment." For the analysis of nucleotide sequences, consideration must in turn be given to both complementary strands, and to all three possible reading frames in each case, and to the degeneracy of the genetic code and the organism-specific codon usage. Alignments are now prepared using computer programs, for example the FASTA or BLAST algorithms; this procedure is described, for example, by D. J. Lipman and W. R. Pearson in *Science*, Vol. 227 (1985), pp. 1435-1441.

A compilation of all positions in conformity in the sequences that have been compared is referred to as a "consensus sequence".

A comparison of this kind also allows conclusions as to the similarity or homology of the sequences that are being compared. This is reproduced as a percentage identity (i.e., the proportion of identical nucleotides or amino acid residues at the same positions or in positions corresponding to one another in an alignment). A broader construction of the term "homology" also incorporates the conserved amino acid exchanges into this value. The term used is then "percentage similarity". Such conclusions can be reached over entire proteins or genes, or only over individual regions.

Homologous regions of different proteins are defined by conformities in the amino acid sequence. These can also be characterized by identical function. It can range up to complete identity in very small regions (so-called "boxes") that encompass only a few amino acids and usually perform functions essential to overall activity. The "functions" of the homologous regions are to be understood as very small subfunctions of the function performed by the entire protein, for example the formation of individual hydrogen bridge bonds in order to complex a substrate or a transition complex.

Such sequence comparisons or alignments also serve in particular to ascertain mutually corresponding positions in different molecules. In an alignment of different enzymes, for example, an identification can be made as to which positions in the respective amino-acid or nucleic-acid sequence correspond to one another, even if the respective sequences, for example, exhibit different overall lengths or different domains or subsequences, or if additional amino acids or nucleotides are present within a sequence. A specific position in a first sequence can thus be associated with a corresponding position in a second sequence, in which context it is entirely possible that the mutually corresponding positions are located at different points in the molecule. Different amino acid residues can furthermore be present at corresponding positions. A concrete indication is therefore given, for such sequence comparisons or for the determination of a position, as to which position is involved and which enzyme was the starting point, i.e. which counting method is to be used as a basis for position determination.

For the subjects of the invention that follow, what is used for position determination is the amino acid sequence of the mature protein of the alkaline protease from *Bacillus lentus* DSM 5483, which is disclosed in International Application WO 91/02792 A1 and has a length of 269 amino acid residues (referred to in the present Application as "the alkaline protease from *Bacillus lentus*").

In a further embodiment of the invention, the washing or cleaning agent includes a protease obtained from an initial protease by at least one modification of an amino acid, the modification being a substitution or insertion of an amino acid in that region of the amino acid sequence that, in an alignment, is associated with positions 95 to 103 of the alkaline protease from *Bacillus lentus.*

Particularly preferably, a protease variant of this kind is a variant having an insertion of a single amino acid after one or more of positions 95, 96, 97, 98, 99, 100, 101, 102, and/or 103, and very particularly preferably between positions 97 and 98 and/or positions 99 and 100.

In a further embodiment of the invention, the washing or cleaning agent includes a protease obtained from an initial protease by at least one modification of an amino acid that, in an alignment, are associated with positions 3, 4, 36, 42, 43, 47, 56, 61, 69, 87, 96, 99, 101, 102, 104, 114, 118, 120, 130, 139, 141, 142, 154, 157, 188, 193, 199, 205, 211, 224, 229, 236, 237, 242, 243, 250, 253, 255, and 268 of the alkaline protease from *Bacillus lentus*, the modification being a substitution, insertion, or deletion of an amino acid.

Particularly preferably, an amino acid modification with respect to the initial molecule occurs at one or more of the following positions: 3, 4, 43, 61, 188, 193, 199, 211, 224, 250, and 253 (counted in accordance with the alkaline protease from *Bacillus lentus*), particularly preferably having one or more of the amino acid exchanges X3T, X4I, X43V, X61A, X188P, X193M, X199I, X211L, X211D, X211E, X211G, X211N or X211Q, X224V, X250G, and/or X253N. The protease is, in particular, a variant having a point mutation at position 211, by preference having a substitution of a single amino acid at that position, particularly preferably having the amino acid substitution X211L. The aforesaid position indications refer once again to those amino acid residues that are associated in an alignment with the aforesaid positions of the alkaline protease from *Bacillus lentus.*

Washing or cleaning agents according to the present invention can contain just one type of enzyme. Alternatively, they can also contain further enzymes at an effective concentration in the agent. A further subject of the invention is therefore directed towards agents that contain one or more enzymes, all enzymes established in the existing art for these purposes being usable in principle. Preferably usable as further enzymes are enzymes that can exert a catalytic activity in the agent according to the present invention, particularly proteases, amylases, cellulases, hemicellulases, mannanases, tannases, xylanases, xanthasases, β-glucosidases, carrageenases, oxidases, oxidoreductases, lipases, or esterases, as well as preferably mixtures thereof. The cellulase is by preference a cellulase mixture or a one-component cellulase, by preference or predominantly an endoglucanase and/or a cellobiohydrolase. The oxidoreductase is by preference an oxidase, in particular a choline oxidase, or a perhydrolase.

These enzymes are, in principle, of natural origin; improved variants based on the natural molecules are, however, available for use in washing and cleaning agents and are correspondingly preferred for use. Agents according to the present invention contain enzymes by preference in total quantities from $1\times10^{-8}$ to 5 weight percent, based on active protein. The enzymes are contained in agents according to the present invention preferably from 0.001 to 5 wt %, more preferably from 0.01 to 5 wt %, even more preferably from 0.05 to 4 wt %, and particularly preferably from 0.075 to 3.5 wt %, such that each enzyme that is contained can be present in the aforesaid quantitative proportions.

Protein concentration can be determined with the aid of known methods such as the BCA method (bichinchoninic acid; 2,2'-biquinolyl-4,4'-dicarboxylic acid) or the biuret method (A. G. Gornall, C. S. Bardawill and M. M. David, *J. Biol. Chem., Vol.* 177 (1948), pp. 751-766). Particularly preferably, the further enzymes assist the action of the agent, for example the cleaning performance of a washing or cleaning agent, in terms of specific stains or spots. Particularly preferably, the enzymes exhibit synergistic effects in terms of their action with respect to specific stains or spots (i.e., enzymes contained in the agent composition mutually assist one another in their cleaning performance). Synergistic effects can occur not only between different enzymes, but also between one or more enzymes and further ingredients of the agent according to the present invention.

Enzymes used in agents according to the present invention either derive originally from microorganisms such as the genera *Bacillus, Streptomyces, Humicola*, or *Pseudomonas*, and/or are produced in accordance with biotechnological methods known per se by suitable microorganisms (e.g., by transgenic expression hosts of the *Bacillus* species or by filamentous fungi).

In agents according to the present invention, the enzyme or enzymes as well as the stabilizing compound are preferably combined with one or more of the following ingredients: nonionic, anionic, and/or cationic surfactants, bleaching agents, bleach activators, bleach catalysts, builders and/or cobuilders, acids, alkaline substances, hydrotropes, solvents, thickeners, sequestering agents, electrolytes, optical brighteners, anti-gray agents, corrosion inhibitors, in particular silver protectants (silver corrosion inhibitors), soil release active substances, color transfer inhibitors, foam inhibitors, abrasives, dyes, scents, perfumes, antimicrobial active substances, UV protectants or absorbers, antistatic agents, luster agents and skin protectants, further stabilizers, in particular enzyme stabilizers, and other compounds that are known from the existing art. A further subject of the present invention is thus represented by washing or cleaning agents which are characterized in that they contain at least one further component that is selected from the group made up of surfactants, builders, acids, alkaline substances, hydrotropes, solvents, thickening agents, bleaching agents, dyes, perfumes, corrosion inhibitors, sequestering agents, electrolytes, optical brighteners, anti-gray agents, silver corrosion inhibitors, color transfer inhibitors, foam inhibitors, abrasives, UV absorbers, solvents, antistatic agents, luster agents, and skin protectants. Agents according to the present invention preferably contain at least one complexing agent and/or builder substances, particularly a zeolite builder, and/or a nonionic surfactant, preferably a hydroxy mixed ether, and/or optical brighteners, the optical brightener being diphenyl compounds, in particular distyrylbiphenyl derivatives, and/or stilbene-triazine derivatives.

The ingredients selected as well as the conditions under which the agent is used (e.g., temperature, pH, ionic strength, redox conditions, or mechanical influences) should be optimized for the particular cleaning problem. Usual temperatures for washing and cleaning agents include ranges from 10° C. for manual agents to 20° C., 30° C., 40° C., 60° C. and as much as 95° C. for automatic agents or technical applications. Since the temperature in modern washing machines and dishwashers is usually continuously adjustable, all intermediate temperature steps are also included. The ingredients of the relevant agents are preferably coordinated with one another. Synergies in terms of cleaning performance are preferred. Particularly preferred in this regard are synergies that exist in a temperature range between 20° C. and 60° C., since the enzyme or enzymes contained in the agents according to the present invention are also catalytically active in this temperature range.

In a further embodiment of the invention, the washing or cleaning agent is characterized in that it contains at least one further stabilizer. At least two compounds that bring about stabilization of a contained enzyme, by preference a protease, are therefore present in such an agent. These compounds preferably act synergistically, i.e. the stabilizing effect achieved by both compounds exceeds the sum of the two individual stabilizing effects. IN a preferred embodiment, the stabilizer(s) involve(s) one or more polyols, in particular glycerol or 1,2-ethylene glycol, an antioxidant, lactate or one or more lactate derivatives, or combinations thereof. In likewise preferred fashion, this refers to one or more of those enzyme-stabilizing or -inhibiting compounds that are disclosed in International Patent Applications WO 07/113241 A1 or WO 02/008398.

A further subject of the invention is use of a compound of the general structural formula

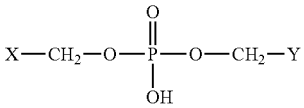

wherein X is an aliphatic or an aromatic residue, and Y is an aliphatic or an aromatic residue, as a reversible inhibitor of an enzyme in a washing or cleaning agent. This is because, as already stated above, these compounds bring about, because of their mechanism of action as a reversible inhibitor, an advantageous stabilization of the enzyme in the washing or cleaning agent. In a preferred embodiment of the invention, the use is characterized in that the residues X and Y are identical. In a further preferred embodiment of the invention, the use is characterized in that the residue X is selected from the group made up of —$CH_2$—$CH_2$—$CH_3$, phenyl. In a further embodiment of the invention, the use is characterized in that the residue Y is selected from the group made up of: —$CH_2$—$CH_2$—$CH_3$, phenyl.

In a further preferred embodiment of this subject of the invention, the enzyme is chosen from protease, amylase, cellulase, hemicellulase, mannanase, tannase, xylanase, xanthanase, β-glucosidase, carrageenase, oxidase, oxidoreductase, lipase, esterase, or mixtures thereof. Particularly preferably, the enzyme is a protease, preferably a serine protease, more preferably a subtilase, and particularly preferably a subtilisin.

On the basis of the above-described advantageous uses according to the present invention of such a compound for stabilization of an enzyme in a washing or cleaning agent, such a combination of enzyme and stabilizer is likewise to be used advantageously in the manufacture of a corresponding washing or cleaning agent. A further subject of the invention is therefore the use of an enzyme and of a compound of the general structural formula—

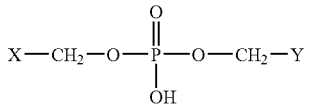

wherein X is an aliphatic or an aromatic residue, and Y is an aliphatic or an aromatic residue, to manufacture a washing or cleaning agent. The compound is, in particular, one in which the residues X and Y are identical, and/or the residue X is selected from the group made up of: —CH—$_2$—$CH_2$—$CH_3$, phenyl, and/or the residue Y is selected from the group made up of: —$CH_2$—$CH_2$—$CH_3$, phenyl.

In a preferred embodiment, this subject of the invention is characterized in that the enzyme is selected from the group made up of: protease, amylase, cellulase, hemicellulase, mannanase, tannase, xylanase, xanthanase, β-glucosidase, carrageenase, oxidase, oxidoreductase, lipase, esterase, or mixtures thereof. Particularly preferably, the enzyme is a protease, preferably a serine protease, more preferably a subtilase, and particularly preferably a subtilisin.

A further subject of the invention is a washing or cleaning method in which an enzyme that is inhibited and/or stabilized with a compound of the general structural formula—

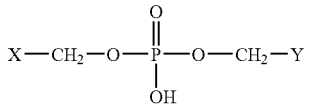

wherein X is an aliphatic or an aromatic residue, and Y is an aliphatic or an aromatic residue, is effective. The compound is in particular one in which the residues X and Y are identical, and/or the residue X is selected from the group made up of: —$CH_2$—$CH_2$—$CH_3$, phenyl, and/or the residue Y is selected from the group made up of: —$CH_2$—$CH_2$—$CH_3$, phenyl.

This is because, as already stated above, these compounds bring about, on the basis of their mechanism of action as a reversible inhibitor, an advantageous stabilization of the enzyme in the washing or cleaning agent, so that the enzyme activity available for the washing or cleaning method is higher as compared with a washing or cleaning agent in which the enzyme was not stabilized. In a preferred embodiment, this subject of the invention is characterized in that the enzyme is selected from the group made up of: protease, amylase, cellulase, hemicellulase, mannanase, tannase, xylanase, xanthanase, β-glucosidase, carrageenase, oxidase, oxidoreductase, lipase, esterase, or mixtures thereof. Particularly preferably, the enzyme is a protease, preferably a serine protease, more preferably a subtilase, and particularly preferably a subtilisins.

In a preferred embodiment of the invention, the washing or cleaning method is further characterized in that a washing or cleaning agent according to the present invention, as described above, is utilized.

A logical result of the advantageous application of washing or cleaning agents according to the present invention in washing or cleaning methods is that the washing or cleaning agents according to the present invention are advantageously usable for cleaning purposes. A further subject of the invention is therefore represented by the use of a washing or cleaning agent, as described above, to wash and/or clean textiles and/or hard surfaces.

All states of affairs, subjects, and embodiments described for washing or cleaning agents according to the present invention are also applicable to all aforementioned uses according to the present invention and to all methods according to the present invention. Reference is therefore explicitly made at this juncture to the disclosure at the corresponding point, with the instruction that said disclosure is also applicable to all aforementioned uses and methods according to the present invention.

The Examples that follow explain the invention further but without limiting it thereto.

EXAMPLES

Example 1

Investigation of Residual Protease Activity in the Presence of an Inhibitor

In order to demonstrate that the compounds set forth below exert an effect that inhibits protease activity, and thus exhibit a stabilizing effect, the residual proteolytic activity of *Bacillus lentus* alkaline protease F49 (in accordance with WO 95/23221 A1) in the presence of said compounds was ascertained.

In parallel reaction batches, the succinyl-alanine-alanine-proline-phenylalanine-para-nitroanilide substrate (AAPF-pNA; Bachem L-1400) and $5\times10^{-9}$ or $1\times10^{-8}$ M of the protease were prepared in 100 mM BrijTM35 Tris buffer, pN 6.8, 0.1% (w/v). The compounds to be tested (listed below) were added at a final concentration of 10 mM. They were each dissolved in anhydrous DMSO, the effects of DMSO on enzymatic activity having been corrected via the corresponding reference having the same quantity of DMSO but without the relevant compound. Incubation occurred for 5 min at pH 8.6 and 25° C. The corresponding reaction mixture with protease, but without the relevant compound, served as a comparison. The protease activity in these comparison batches was set at 100%.

The following compounds were investigated in this fashion

V1: dibutyl phosphate, and

V2: dibenzyl phosphate.

The compounds resulted in a residual protease activity of less than 60%. Among them, V1 is the strongest, and therefore most suitable, protease inhibitor or stabilizer, followed by V2. The residual protease activities were 45% for V1 and 56% for V2.

On the basis of these results, these compounds are very well suited for stabilizing the enzymatic activities in protease-containing washing and cleaning agents during storage.

Example 2

Investigation of the Shelf Stability of Protease-Containing Washing and Cleaning Agents in the Presence of Enzyme Stabilizers According to the Present Invention A liquid washing agent having the following composition was prepared as a baseline recipe (all indications in percent by weight): 0.3 to 0.5% xanthan gum, 0.2 to 0.4% antifoaming agent, 6 to 7% glycerol, 0.3 to 0.5% ethanol, 4 to 7% FAEOS, 24 to 28% nonionic surfactant, 1% boric acid, 1 to 2% sodium citrate (dihydrate), 2 to 4% soda, 14 to 16% coconut fatty acid, 0.5% HEDP, 0 to 0.4% PVP, 0 to 0.05% optical brightener, 0 to 0.001% dye, remainder: demineralized water.

The inhibiting compounds per Example 1 that were to be tested, and 1,275,000 HPE/I B. Lentus alkaline protease F49, were added to this recipe. The protease activity, indicated in HPE (Henkel protease units), was determined according to van Raay, Saran, and Verbeek, in accordance with the publication "Zur Bestimmung der proteolytischen Aktivität in Enzymkonzentraten und enzymhaltigen Wasch-, Spül- und Reinigungsmitteln" [Determining proteolytic activity in enzyme concentrates and enzyme-containing washing, dishwashing, and cleaning agents] in Tenside (1970), Vol. 7, pp. 125-132.

Storage occurred in airtight sealed vessels at 30° C. over time periods of various lengths.

For evaluation, the initial values for the proteolytic activity of the relevant agent were compared with the values determined after storage. The higher the activity remaining after storage, the better the contained protease had been inactivated during storage, and the more suitable the relevant compound is as a stabilizer according to the present invention.

All the compounds investigated exhibited an unequivocally stabilizing effect.

We claim:

1. Washing or cleaning agent comprising:

an enzyme and a boron-free phosphate compound of the general structural formula

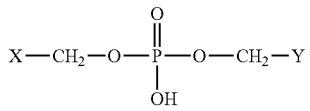

wherein X is $—CH_2—CH_2—CH_3$ or phenyl, and Y is $—CH_2—CH_2—CH_3$ or phenyl, wherein the compound has an inhibition constant ($K_i$) from 0.03 to 5 mM with respect to the enzyme, thereby stabilizing the enzyme during storage.

2. Washing or cleaning agent according to claim 1, wherein the enzyme is present at a concentration from 2 μg to 20 mg per gram of the agent.

3. Washing or cleaning agent according to claim 1, wherein the compound is present at a concentration of up to 50 mg per g of the agent.

4. Washing or cleaning agent according to claim 1, wherein the molar ratio of the compound to the enzyme is from 1:1 to 1,000:1.

5. Washing or cleaning agent according to claim 1, wherein the quantity of the compound contained in the agent, based on the stabilized enzyme, is from 0.01 to 100 times the inhibition constant $K_i$.

6. Washing or cleaning agent according to claim 1, wherein the agent is predominantly solid in form, or predominantly liquid, pasty, or gel in form.

7. Washing or cleaning agent according to claim 1, wherein the enzyme is chosen from protease, amylase, cellulase, hemicellulase, mannanase, tannase, xylanase, xanthanase, β-glucosidase, carrageenase, oxidase, oxidoreductase, lipase, esterase, or mixtures thereof.

8. Washing or cleaning agent according to claim 7, wherein the enzyme is a protease.

9. Washing or cleaning agent according to claim 8, wherein the protease is a modified protease obtained from an initial protease by at least one modification of an amino acid, the modification being a substitution, insertion, or deletion of an amino acid, and it is at least 90% identical to the initial protease at the amino acid level.

10. Washing or cleaning agent according to claim 8, wherein the protease is a modified protease obtained from an initial protease by at least one modification of an amino acid, the modification being a substitution or insertion of an amino acid in that region of the amino acid sequence that, in an alignment, is associated with positions 95 to 103 of the alkaline protease from *Bacillus lentus*.

11. Washing or cleaning agent according to claim 8, wherein the protease is a modified protease obtained from an initial protease by at least one modification of an amino acid that, in an alignment, is associated with positions 3, 4, 36, 42, 43, 47, 56, 61, 69, 87, 96, 99, 101, 102, 104, 114, 118, 120, 130, 139, 141, 142, 154, 157, 188, 193, 199, 205, 211, 224, 229, 236, 237, 242, 243, 250, 253, 255, and 268 of the alkaline protease from *Bacillus lentus*, the modification being a substitution, insertion, or deletion of an amino acid.

12. Washing or cleaning agent according to claim 1 further comprising at least one further stabilizer.

13. Washing or cleaning agent according to claim 12, wherein the at least one further stabilizer is a polyol, an antioxidant, lactate or one or more lactate derivatives, or combinations thereof.

14. Washing or cleaning method comprising washing a surface with a washing or cleaning agent according to claim 1.

15. Washing or cleaning method comprising:

choosing an enzyme from protease, amylase, cellulase, hemicellulase, mannanase, tannase, xylanase, xanthanase, β-glucosidase, carrageenase, oxidase, oxidoreductase, lipase, esterase, or mixtures thereof, and inhibiting and/or stabilizing the enzyme with a boron-free phosphate compound of the general structural formula

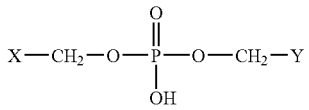

wherein X is selected from the group consisting of —$CH_2$—$CH_2$—$CH_3$ or phenyl, and Y is selected from the group consisting of —$CH_2$—$CH_2$—$CH_3$ or phenyl.

* * * * *